US005271854A

United States Patent [19]

Staub et al.

[11] Patent Number: 5,271,854

[45] Date of Patent: Dec. 21, 1993

[54] HIGH TEMPERATURE LUBRICANT CONTAINING CARBOXYLATED STYRENE-BUTADIENE LATEX

[75] Inventors: Hans-Rudolf Staub, Eggenwil; Jacques Périard, Sins, both of Switzerland

[73] Assignee: Lonza Ltd., Gampel/Valais, Switzerland

[21] Appl. No.: 393,064

[22] Filed: Aug. 4, 1989

Related U.S. Application Data

[63] Continuation of Ser. No. 318,468, Feb. 28, 1989, abandoned, which is a continuation of Ser. No. 183,472, Apr. 15, 1988, abandoned, which is a continuation of Ser. No. 97,110, Sep. 16, 1987, abandoned.

[30] Foreign Application Priority Data

Sep. 23, 1986 [CH] Switzerland ..... 3800/86

[51] Int. Cl.[5] ..... C10M 107/14; C10M 107/28; C10M 145/10; C10M 125/02

[52] U.S. Cl. ..... 252/29; 252/49.5; 524/535; 524/847

[58] Field of Search ..... 252/10, 25, 29, 30, 252/49.5; 524/495, 575, 847

[56] References Cited

U.S. PATENT DOCUMENTS

| | | | |
|---|---|---|---|
| 2,176,879 | 10/1939 | Bartell | 252/22 |
| 2,588,625 | 3/1952 | Ferner et al. | 117/49 |
| 2,719,386 | 10/1955 | Johnson et al. | 49/82 |
| 2,735,814 | 2/1956 | Hodson et al. | 252/30 |
| 3,198,735 | 8/1965 | Lamson | 252/25 |
| 3,242,075 | 3/1966 | Hunter | 252/22 |
| 3,341,454 | 9/1967 | Chor et al. | 252/22 |
| 3,344,065 | 9/1967 | Gansheimer et al. | 252/18 |
| 3,384,580 | 5/1968 | Peace | 252/29 |
| 3,472,770 | 10/1969 | Preston et al. | 252/23 |
| 3,525,692 | 8/1970 | Dodson et al. | 252/29 |
| 3,770,639 | 11/1973 | Dodson et al. | 252/29 |
| 3,801,504 | 4/1974 | Stone | 252/23 |
| 3,833,502 | 9/1974 | Leary et al. | 252/49.5 |
| 3,838,048 | 9/1974 | Hedge | 252/12 |
| 3,908,038 | 9/1975 | Nienart | 427/27 |
| 3,983,042 | 9/1976 | Jain et al. | 252/49.5 |
| 4,039,337 | 8/1977 | Brown et al. | 106/38 |
| 4,050,932 | 9/1977 | Lemmer | 75/211 |
| 4,052,323 | 10/1977 | Feneberger et al. | 252/49.5 |
| 4,055,503 | 10/1977 | Anselment et al. | 252/12 |
| 4,104,178 | 8/1978 | Jain et al. | 252/30 |
| 4,115,283 | 9/1978 | Needham | 252/12.4 |
| 4,140,834 | 2/1979 | Marcantonio et al. | 428/419 |
| 4,206,060 | 6/1980 | Yamamoto et al. | 252/22 |
| 4,206,061 | 6/1980 | Dodson et al. | 252/29 |
| 4,228,020 | 10/1980 | Papay | 252/29 |
| 4,314,907 | 2/1982 | Defretin et al. | 252/22 |
| 4,321,295 | 3/1982 | Smith-Johannsen | 428/206 |
| 4,357,249 | 11/1982 | Mellor | 252/12 |
| 4,575,430 | 3/1986 | Periard et al. | 252/12.6 |

FOREIGN PATENT DOCUMENTS

| | | | |
|---|---|---|---|
| 0164637 | 12/1985 | European Pat. Off. . | |
| 2104041 | 8/1971 | Fed. Rep. of Germany . | |
| 2450716 | 11/1975 | Fed. Rep. of Germany | 252/29 |
| 2430249 | 2/1976 | Fed. Rep. of Germany . | |
| 2921620 | 12/1979 | Fed. Rep. of Germany . | |
| 18799 | 1/1984 | Japan . | |
| 596294 | 10/1977 | Switzerland . | |
| 609728 | 3/1979 | Switzerland . | |
| 586195 | 12/1977 | U.S.S.R. . | |
| 981351 | 12/1982 | U.S.S.R. . | |
| 1030405 | 7/1983 | U.S.S.R. . | |
| 2036071 | 3/1979 | United Kingdom . | |

OTHER PUBLICATIONS

Boundy, Boyers "Styrene, Its Polymers, Copolymers and Derivatives," Reinhold Pub. Corp. N.Y. (1956) pp. 857-858, 859-860.

Chem. Abstracts, 109708k (1974).

*Primary Examiner*—David Brunsman

*Attorney, Agent, or Firm*—Fisher, Christen & Sabol

[57] ABSTRACT

Lubricant for use in hot forming of steel at high temperatures and especially in the production of seamless tubes in so-called multiple pipe mills, in which the lubricant must adhere water-resistant to the tool. This is achieved by a lubricant containing, besides a solid lubricant and a thickening agent, a binding agent from the series of the carboxylated styrene-butadiene latices.

1 Claim, No Drawings

HIGH TEMPERATURE LUBRICANT CONTAINING CARBOXYLATED STYRENE-BUTADIENE LATEX

This application is a continuation of prior U.S. application Ser. No. 07318,468 (abandoned) Feb. 28, 1989, which is a continuation of application 07/183,472 (abandoned) Apr. 15, 1988, which is a continuation of application 07/097,110 (abandoned) Sep. 16, 1987.

BACKGROUND OF THE INVENTION

1. Field of the Invention

The invention relates to a lubricant for use in the shaping of steel at high temperatures, containing a solid lubricant, a binding agent and a thickening agent. 2. Background Art It is known to use lubricants containing, e.g., graphite, alkylene polymers or copolymers and a dispersing agent or film stabilizer, for the hot forming of metals, especially for the lubrication of the mandrel, in the production of seamless tubes (German Published Patent Specification 2,450,716). Such lubricants must meet a multitude of requirements, especially when they are used in so-called MPM (multiple pipe mills) trains. Thus, it must be possible to apply the lubricant easily, which can be economically accomplished only with the help of an aqueous dispersion, the lubricant must remain behind after removal of the support, in other words, of the water, as a water-resistant, evenly thick film. This film must exhibit a high mechanical stability with homogeneous distribution of the solid lubricant particles up to high temperatures and pressures. An essential share in the fulfillment of these requirements lies with the binding agent. Butadiene and also styrene and styrene with copolymers were mentioned, among others, as binding agents in German Published Patent Specification 2,450,716.

But these known binding agents were unable to meet all of the requirements as such requirements are increasingly made on such lubricants. Butadiene as the binding agent was too soft; styrene on the other hand was unable to form an optimum film even with the usual copolymers. Styrene-butadiene copolymers were also described in European Published Patent Specification 0,164,637 as a component of a high-temperature lubricant. But such formulation requires a considerable amount of an inorganic salt mixture, which, in turn, has adverse effects, e.g., in MPM trains, with regard to a poor water resistance.

BROAD DESCRIPTION OF THE INVENTION

The main object of this invention is to provide a lubricant which does not exhibit said above-described drawbacks and disadvantages. The main object of the invention is achieved according to the invention with a lubricant containing a carboxylated styrene-butadiene latex as the binding agent.

Other objects and advantages of the invention are set out herein or are obvious herefrom to one skilled in the art.

Preferably a carboxylated styrene-butadiene latex with a styrene content of more than 50 percent of styrene, most preferably 70 to 80 percent of styrene, is used as the binding agent. As a rule, the binding agent is added as an aqueous dispersion with a solids content of 40 to 60 percent by weight to the other components of the lubricant.

The dispersing agent, in the present case essentially water, must be added to the mixing liquid, also essentially water, of the ready lubricant dispersion.

The quantity proportions of the ingredients of the lubricant suitably are from 50 to 80 percent by weight of a solid lubricant or solid lubricant mixture, preferably graphite, 20 to 50 percent by weight of the invention binding agent, in relation to its dry mass, and 0.2 to 5.0 percent by weight of a thickening agent.

Further, it is often advantageous to include additives such as wetting agents, emulsifiers, biocides and antioxidants in the ingredients. Their individual quantity proportions depend upon the producer specifications or on preliminary tests and usually are up to 2 percent by weight.

The individual components used which result in the lubricant according to the invention can be selected, for example, from the product groups named below.

Graphite, $MoS_2$ (molybdenum disulfide), $CaF_2$ or BN, for example, can be used as the solid lubricant. Of the solid lubricants, graphite leads to especially good results. From the graphites, those with high purity, e.g., over 96 percent purity and an average particle size of 100 μm.

The lubricant should be available for use as 10 to 60 percent by weight of aqueous dispersion. The dispersion suitably exhibits a viscosity of 500 to 15,000 cp at 10° to 30° C. To attain the viscosity of the dispersion, a thickening agent or a mixture of thickening agents is used. Included among the suitable thickening agents are, e.g., water soluble polysaccharides, alkyl celluloses, such as hydroxyalkyl cellulose or carboxymethyl cellulose, polyvinyl alcohols, polyacrylic acid and its derivatives, neutralized or not neutralized, natural gums and their derivatives (e.g., guar), polyvinyl pyrrolidone, polyethylene oxides, and optionally minerals, such as clays, montmorillonite, modified m ntmorillonite and betonite, and fillers such as natural pitch or natural asphalt.

As noted, the lubricant is applied in the form of an aqueous dispersion. The aqueous dispersion of the lubricant according to the invention can be applied to the tool that can exhibit temperatures of from 80° to more than 350° C. When contact with the hot surface occurs, the aqueous support of the dispersion evaporates and a film of the lubricant in even layer thickness forms. The lubricant film is in homogeneous water-resistant form and is no longer washed off or swollen even by large amounts of the coolant that flow over the tool.

Therefore, the lubricant according to the invention is suitable for the lubrication of a tool, e.g., a mandrel, piercer rod or bottom die, in their use for working of work pieces, e.g., especially in hot forming of steel and rolling of hollow billets into seamless tubes in so-called MPM trains, optionally also in continuous trains, push bench installations, bar extrusion presses or heading presses.

The demands that can be made on the invention lubricant when used in MPM trains can be completely met by the invention lubricant. In the case of the preferred application and processing temperature of 80° to 350° C, the desired film forms in a thickness of 10 to 100 μm. The film is water-resistant, i.e., the subsequent cooling with water does not affect the film in any way. At a mandrel temperature of from 150° to 250° C, the film has good mechanical properties (e.g., a scratch hardness of 6.5 N with the scratch hardness test according to the Sikkens method). The heat resistance of the lubricant is guaranteed without hesitation up to 350° C.

These values could not be simultaneously attained with the prior art lubricants, as is evident for the comparison examples described below.

DETAILED DESCRIPTION OF THE INVENTION

As used herein, all parts, percentages, ratios and proportions are on a weight basis, unless otherwise stated herein or otherwise obvious herefrom to one skilled in the art.

COMPARISON EXAMPLE A

According to German Published Patent Specification 2,450,716

Formulation: solid content, 30 percent; water, 70 percent;

1 Solids:

74.3 percent of graphite 23.2 percent of SBR latex (35 percent of styrene, calculated in relation to solid content of the styrene-butadiene resin or copolymer latex)

2.0 percent of alkyl cellulose 0.5 percent of sodium silicate

Viscosity: 3100 cps., pH =9.2

COMPARISON EXAMPLE B

According to European Published Patent Specification 0,164,637

Formulation: solid content, 30 percent; water,

Solids:

54.0 percent of graphite 11.0 percent of polyphosphate, insoluble 5.0 percent of borax 10.0 percent of sodium silicate 18.0 percent of polystyrene 2.0 percent of alkyl cellulose Viscosity: 2000 cps., pH =11.0

EXAMPLE 1

Example 3 According to the invention

Formulation: solid content, 45 percent; water 55 percent;

Solids:

74.2 percent of graphite 24.3 percent of SBR latex, carboxylated (75 percent of styrene, calculated in relation to the solid content of the styrene-butadiene resin or copolymer latex, carboxylated)

1.0 percent of clay 0.5 percent of antioxidant

Viscosity: 2800 cps., pH =8

In Comparison Examples A and B and Example 1, the solids and the water were processed into dispersions as supports and for test purposes sprayed onto metal surfaces which represent the mandrel. The test results are given in Table I below:

TABLE 1

| Properties of the Lubricant Film | | | | | |
|---|---|---|---|---|---|
| Example No. | | | Comparison Example A | Comparison Example B | Example 1 |
| Temperatures of the mandrel, °C. | | | 600° | 250° | 250° |
| Film Properties | at room temperature 150°-250° C. | Cohesion/adhesion | good | good | good |
| | | Water resistance | good | weak | very good |
| | | Scratch hardness (according to the Sikkens method) | weak | good | good |

What is claimed is:

1. Lubricant for use in the hot forming of steel at a high temperature, comprising 50 to 80 percent by weight of graphite as solid lubricant, 20 to 50 percent by weight, in relation to its dry mass, of a carboxylated styrene-butadiene latex having a styrene content of 70 to 80 percent of styrene, and 0.2 to 5 percent by weight of a thickening agent.

* * * * *